United States Patent [19]

Bauer

[11] Patent Number: 4,611,563

[45] Date of Patent: Sep. 16, 1986

[54] FUEL INJECTION PUMP FOR INTERNAL COMBUSTION ENGINES

[75] Inventor: Manfred Bauer, Ludwigsburg, Fed. Rep. of Germany

[73] Assignee: Robert Bosch GmbH, Stuttgart, Fed. Rep. of Germany

[21] Appl. No.: 678,009

[22] Filed: Nov. 30, 1984

[30] Foreign Application Priority Data

Jan. 7, 1984 [DE] Fed. Rep. of Germany ..... 3400347

[51] Int. Cl.[4] ..... F02M 37/04

[52] U.S. Cl. ..... 123/449; 123/459; 123/506

[58] Field of Search ..... 123/449, 503, 506, 459; 417/289, 282, 294

[56] References Cited

U.S. PATENT DOCUMENTS

| | | | |
|---|---|---|---|
| 4,220,128 | 9/1980 | Kobayashi | 123/449 |
| 4,239,025 | 12/1980 | Konrath et al. | 123/503 |
| 4,403,582 | 9/1983 | Yasuhara | 123/503 |
| 4,407,253 | 10/1983 | Bauer | 123/449 |
| 4,438,246 | 3/1984 | Greiner | 123/503 |
| 4,449,504 | 5/1984 | Furuhashi et al. | 123/503 |
| 4,509,470 | 4/1985 | Ito et al. | 123/449 |

*Primary Examiner*—Magdalen Y. C. Greenlief
*Attorney, Agent, or Firm*—Michael J. Striker

[57] ABSTRACT

A fuel injection pump for self-igniting internal combustion engines includes a displaceable control slide which is operative for blocking a relief conduit provided in the pump for controlling an outflow of a partial quantity of fuel in the pump for affecting the injection time. The control slide is arbitrarily displaceable by a rocker lever which is actuated by a driver by an adjusting lever positioned outside the pump.

5 Claims, 3 Drawing Figures

FUEL INJECTION PUMP FOR INTERNAL COMBUSTION ENGINES

BACKGROUND OF THE INVENTION

The present invention pertains to a fuel injection pump for supplying fuel to injection nozzles of self-igniting internal combustion engines.

In the fuel injection pumps of the foregoing type a housing has a bore in which a pump piston is reciprocated and simultaneously rotated by a cam drive. One of the known fuel injection pumps of the type under discussion is disclosed in the applicant's German publication DE-OS No. 3,013,087 corresponding to U.S. Pat. No. 4,407,253. The control slide provided in this known fuel injection pump is additionally displaced to control the relief conduit by means of an intermediate lever of the rpm governor. This lever has an extension which is engaged at the free end of the control slide, which extends into the suction chamber of the fuel injection pump. The intermediate lever is coupled to the annular slide which surrounds the pump piston and, on the other hand, control the relief conduit for ending the injection and therefore determining the injection quantity. The fuel injection quantity is determined by the rpm governor depending on the load and rpm. The adjustment of the annular slide corresponds not to a predetermined load-to-rpm ratio but to the injection quantity, by the increase or decrease of which the motor rpm is adjusted to a predetermined allowed load or rpm. The annular slide therefore can assume a position for a small injection quantity although rpm is still relatively high and vica versa the annular slide can control a great injection quantity although the motor is in quiet idling. Since the control slide follows, due to the engagement thereof with the extension of the intermediate lever, the movements of the intermediate lever or the annular slide an uncontrolled actuation of the control slide results. It is desirable, however that, besides the actuation of the control slide in dependence on rpm affected by the pressure in the suction chamber, the actuation depending on the load would be obtained. So, for example, if a full load is desired the relief conduit should be blocked by the control slide to achieve a quick adjustment.

SUMMARY OF THE INVENTION

It is an object of the present invention to provide an improved fuel injection pump.

It is another object of this invention to provide a fuel injection pump in which during the shortening of the known hydraulic rpm-dependent actuation of the control slide a load-dependent actuation would be directly arbitrarily obtained. Thereby it would be avoided that rpm due to respective characteristic values of the governor would not affect a delayed actuation of the control slide.

These and other objects of the present invention are attained by a fuel injection pump for supplying fuel to self-igniting internal combustion engines, including housing means in which a pump piston is inserted for reciprocal and rotary movement, said piston defining with said housing means at least one pump work chamber, said housing means further having a suction chamber and a relief conduit connected to said pump work chamber, said pump work chamber being supplied with fuel from said suction chamber during a suction stroke of said piston; and a control slide positioned in said housing means and displaceable for blocking or throttling said relief conduit which controls an outflow of a partial quantity of fuel in the pump, said control slide being arbitrarily displaced.

The pump may include a rocker lever which serves to arbitrarily actuate said control slide, a restoring spring for biasing said control slide, and an adjusting lever actuated from outside of said housing means, said rocker lever having one arm which engages said control slide and another arm which is pivotable upon an application thereto of an adjusting value, said adjusting value being determined by said adjusting lever. Inasmuch as the adjusting lever serves simultaneously for applying a signal to the rpm governor the adjusting value directly corresponds to the load.

The pump may further include a shaft supported in said housing means, said adjusting lever being connected to said shaft outside said housing means; and wherein a pulling level may be provided, connected to said shaft and positioned within said housing means, said pulling lever transmitting an adjusting movement from said adjusting lever to said rocker lever in a force-locking fashion.

The pump may include an axle supported in said housing means, said rocker lever being supported on said axle, said axle being at the same time an axle of an rpm governor.

The rocker lever may be formed of sheet material and be positioned on said axle edgewise, said rocker lever further including two cantilevers which extend at right angles relative thereto, one of said cantilevers being positioned on said one arm and engaging said control slide and take other of said cantilevers overhanging said one cantilever to prevent twisting of said rocker lever.

The second cantilever may have a plate-like portion extended normally thereto, said portion being supported on said axle.

The pump may further include a connecting rod which provides a force-locking connection between said pulling lever and said rocker lever.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
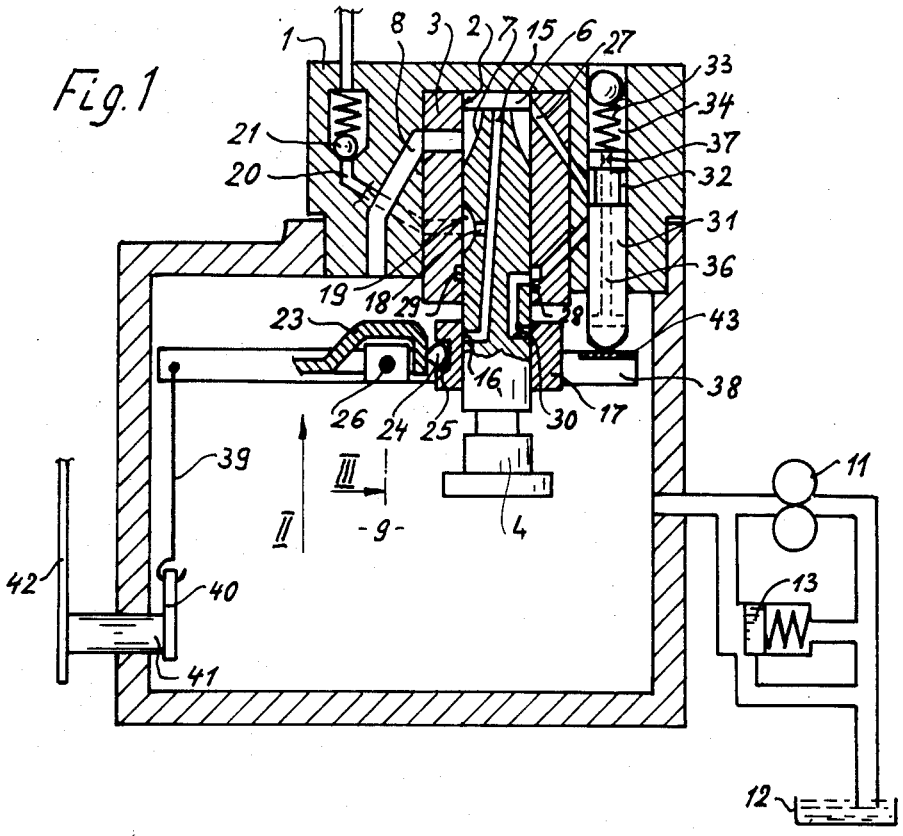
FIG. 1 is a partial sectional view of the fuel injection pump according to the invention.

Referring now to the drawings in detail, and firstly to FIG. 1 thereof, this figure illustrates the fuel injection pump in highly exemplified form. A bore 2 is formed in a cylindrical sleeve 3 inserted into a housing 1 of the fuel injection pump. A pump piston 4 caused to reciprocate counter to the force of the non-illustrated restoring spring and simultaneously to rotate by non-shown but known cam drive means operating in bore 2. Bore 2 together with the pump housing 1 and the pump piston 4 limits a pump work chamber 6. The pump work chamber 6 is supplied with fuel from a suction chamber 9 via longitudinal grooves 7, formed in the peripheral surface of pump piston 4, and via an intake bore 8, extending through the cylindrical sleeve 3, and within housing 1, as long as the pump piston executes its suction or intake stroke (in the downward direction) or when a bottom dead center position due to the underpressure, prevailing in the suction chamber 9, is assumed.

The suction chamber 9 is supplied with fuel from a fuel container 12 via a supply pump 11. The pressure in the suction chamber 9 is controlled in accordance with rpm in conventional fashion by means of a pressure control valve 13 so that the pressure in the suction chamber 9 increases as the rpm increases.

A longitudinal conduit 15 extends within the pump piston 4, which conduit at its one end is connected with the pump work chamber 6 and at its other end is connected to the suction chamber 9. An exit opening 16 of conduit 15 is controlled by an annular slide 17 which is axially displaceable on the pump piston 4. A transverse bore 18 branches off from the longitudinal conduit 15 approximately midway thereof. Bore 18 opens into a distributor groove 19 formed in the peripheral surface of piston 4. During the compression stroke (in the upward direction) of the pump piston 4 and upon the rotation of the latter, the intake bore 8 is closed and one of pressure lines 20 is opened via the longitudinal bore 15, transverse bore 18 and the distributor groove 19 so that fuel under high pressure can flow out from the pump work chamber 6 into the respectively opened pressure line or conduit 20. The pressure lines 20 lead via a check valve 21 to respective pressure conduits which in turn lead to injection nozzles arranged on the internal combustion engine. The number of the pressure lines 20 corresponds to the number of the cylinders of the internal combustion chamber.

After a predetermined feed supply stroke of the pump piston 4 has been executed the exit opening 16 of longitudinal conduit 15 is opened due to the emergence thereof from the annular slide 17, whereby the fuel injection is interrupted and a further supplied fuel flows back from the pump work chamber 6 into the suction chamber 9. Thus, greater or smaller amounts of fuel can be injected in dependence upon the position of annular slide 17.

The annular slide 17 is coupled by means of an intermediate lever 23 to a non-illustrated rpm governor provided on the engine. The rpm governor is operated, on the one hand in accordance with the load applied by a driver and, on the other hand, in accordance with the starting rpm of the internal combustion engine. The displacement of the annular slide 17 on the pump piston 4 is therefore effected depending on the load and rpm. The intermediate lever 23 includes a head 24 which engages in a recess 25 formed in the annular slide 17. The intermediate lever 23 is pivotally supported on an axle or shaft 26 so as to effect the movement transmission. The displacement of the annular slide 17 in the downward direction effects a reduction in the quantity of the injected fuel due to an advanced revealing of the exit opening 16 whereas the displacement of the annular slide 17 in the upward direction effects an increase in the quantity of the injected fuel because of the closing of the exit opening 16 and preventing fuel from escape. For the starting rpm and with required maximal quantities of injected fuel the annular slide 17 assumes it highest position at which the exit opening 16 is no longer opened so that the entire quantity of fuel can be supplied for the injection.

A relief conduit 27, which is partially formed in sleeve 3 and partially in the housing 1, establishes a further connection between the pump work chamber 6 and the suction chamber 9. The relief conduit 27 is controlled at an orifice 28 adjoining the pump piston 4. The position of control orifice 28 is selected so that the relief conduit 27 is opened only after a predetermined stroke of the pump piston 4 has been executed, although at that point in time one of the pressure lines 20 will already be opened via the distributor groove 19. This results in the fact that the fuel outflow via the relief conduit 27 has no influence on the pressure in the pump work chamber 6 at the injection onset so that with all injection strokes an identical and sufficiently high pressure is obtained in the pump work chamber 6 for the injection onset. In order to obtain a precise opening the relief conduit 27 discharges at the orifice 28 into an annular groove 29 provided in the sleeve 3. Groove 29 cooperates with a conduit 30 extending within the pump piston 4. The end of the conduit 30 facing the orifice 28 is controlled by the upper edge of the annular sleeve 17 and remains closed in accordance with the control position of the annular slide 17 at the starting rpm, so that no fuel can flow out from the pump work chamber 6 into the suction chamber 9 via the relief conduit 27. An overtravel of the annular groove 29 can be provided in accordance with the width of this annular groove so that the opening of the relief conduit 27 would occur solely for a predetermined section of the stroke. Another end of conduit 30, which is controlled by slide 17, emerges sooner or later from the inner bore of the annular slide in accordance with the position of the annular slide, and at partial load and during idling, and also at a comparatively deeper position of the annular sleeve 17, the opening of the conduit 30 takes place correspondingly earlier so that in each case the outflow can occur, which would cause quiet running of the engine.

The relief conduit 27 is additionally controlled by a control slide 31. An annular groove 32 is provided in the control slide 31. The first portion of the relief conduit 27, which is under high pressure derived from the pump work chamber 6, discharges into the annular groove 32. The second portion of the relief conduit 27, which opens into the annular groove 29, can be blocked by the peripheral surface of the control slide 31 when this slide assumes the position illustrated in FIG. 1. This position corresponds to rpm levels above idling or lower partial-load rpm levels. During the idle running and lower partial-load rpm the control slide 31 is further displaced downwardly by a spring 33 to the position in which both portions of the relief conduit 27 are communicated with each other through the annular groove 32.

A chamber 34 receiving the spring 33 is limited by the control slide 31. A pressure-compensating bore 36 connects the chamber 34 with the suction chamber 9. A throttle 37 may be provided in the pressure-compensating bore 36 so that the movement of the control slide 31 can be damped.

Control slide 31 is actuated against the force of spring 33 by means of an actuating rocker lever 38 which is supported on the aforementioned axle or shaft 26. At the end of the rocker lever 38, facing away from the control slide 31, this lever engages via a connecting rod 39, a pulling lever 40 which is supported on an axle or shaft 41 in the housing 1 and is pivotable by means of an adjusting lever 42. The latter serves also as a loading lever of the rpm governor. The given adjustment movement of the adjusting lever is administered by the non-shown but any suitable known means, preferably from the pulling lever 40 to the non-shown rpm governor. Therefore, by this arrangement the load imposed by a driver by the adjustment of the adjusting lever 42 is transmitted directly to the control slide 31 so that the relief conduit 27 is blocked by the control slide 31 at lower partial load.

Figure 2:
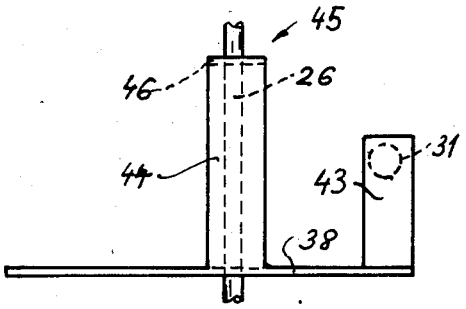
FIG. 2 is a plan view of the actuating lever, seen from arrow 11 of FIG. 1.
Figure 3:
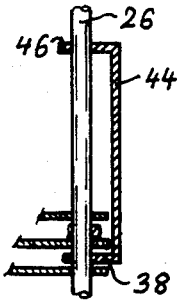
FIG. 3 is a sectional view taken on line III—III of FIG. 1.

The rocker lever 38 is formed as a leaf lever or a lever of sheet material and is pivotable in its plane whereby a great lever stability results. As shown in FIGS. 2 and 3 rocker lever 38 includes two cantilevers or arms 43 and 44. Cantilever 43 is bent at right angles relative to the upper edge of lever 38. Cantilever 43 serves to transmit the adjustment movement of the rocker lever 38 to the control slide 31. The second cantilever 44 serves as an overhang arm of the lever 38 to prevent its twisting. Cantilever 43 effects that a tilting moment of rocker lever 38 is absorbed by the second cantilever 44 which has at the end 45 a plate portion 46 which is supported on the axle or shaft 26.

It will be understood that each of the elements described above, or two or more together, may also find a useful application in other types of fuel injection pumps for internal combustion engines differing from the types described above.

While the invention has been illustrated and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel injection pump for supplying fuel to self-igniting internal combustion engines, comprising housing means in which a pump piston is inserted for a reciprocal and rotary movement, said piston defining with said housing means at least one pump work chamber, said housing means further having a suction chamber and a relief conduit leading at least partly through said housing means from said suction chamber to said pump work chamber, said pump work chamber being supplied with fuel from said suction chamber during a suction stroke of said piston; a control slide positioned in said housing means and displaceable for blocking or throttling said relief conduit partly leading through said housing means thereby controlling an outflow of a partial quantity of fuel in the pump, said control slide being arbitrarily displaced; a rocker lever which serves to arbitrarily actuate said control slide; a restoring spring for biasing said control slide; an adjusting lever actuated from outside of said housing means, said rocker lever having one arm which engages said control slide and another arm which is pivotable upon an application thereto of an adjusting value, said adjusting value being determined by said adjusting lever; a shaft supported in said housing means, said adjusting lever being connected to said shaft outside said housing means; and a pulling lever connected to said shaft and positioned within said housing means, said pulling lever transmitting an adjusting movement from said adjusting lever to said rocker lever in a force-locking fashion, wherein the adjusting movement of said pulling lever is applied to an rpm governor as a load value.

2. The fuel injection pump as defined in claim 1, further including an axle supported in said housing means, said rocker lever being supported on said axle, said axle being at the same time an axle of an rpm governor.

3. The fuel injection pump as defined in claim 2, wherein said rocker lever is formed of sheet material and is positioned on said axle edgewise, said rocker lever further including two cantilevers which extend at right angles relative thereto, one of said cantilevers being positioned on said one arm and engaging said control slide and the other of said cantilevers overhanging said one cantilever to prevent twisting of said rocker lever.

4. The fuel injection pump as defined in claim 3, wherein said second cantilever has a plate-like portion extended normally thereto, said portion being supported on said axle.

5. The fuel injection pump as defined in claim 4, further including a connecting rod which provides a force-locking connection between said pulling lever and said rocker lever.

* * * * *